US005810709A

United States Patent [19]

Simenauer et al.

[11] Patent Number: 5,810,709

[45] Date of Patent: Sep. 22, 1998

[54] MAGNETIC DOOR SEAL INFANT INCUBATOR

[75] Inventors: Robert M. Simenauer, Ellicott City; Thomas C. Jones, Columbia, both of Md.

[73] Assignee: Ohmeda Inc., Liberty Corner, N.J.

[21] Appl. No.: 801,670

[22] Filed: Feb. 18, 1997

Related U.S. Application Data

[63] Continuation-in-part of Ser. No. 492,683, Jun. 20, 1995, abandoned.

[51] Int. Cl.[6] ..... A61G 10/00

[52] U.S. Cl. ..... 600/22

[58] Field of Search ..... 600/21, 22

[56] References Cited

U.S. PATENT DOCUMENTS

| | | | |
|---|---|---|---|
| 3,797,172 | 3/1974 | Cannon . | |
| 5,090,617 | 2/1992 | Swan et al. | 236/3 |
| 5,308,310 | 5/1994 | Roff et al. . | |
| 5,360,741 | 11/1994 | Hunnell | 435/290 |

FOREIGN PATENT DOCUMENTS

| | | |
|---|---|---|
| 2079947 | 4/1994 | Canada . |
| 2067077 | 7/1981 | United Kingdom . |
| 2276409 | 9/1994 | United Kingdom . |

*Primary Examiner*—John P. Lacyk
*Assistant Examiner*—Samuel Gilbert
*Attorney, Agent, or Firm*—Roger M. Rathbun

[57] ABSTRACT

An infant incubator having a base and a hood positioned atop of the base to form an infant compartment therebetween. The hood has a front access door that is hinged so as to move between an open and a closed position. The edge of the door opposite the hinged part has a magnetic strip that mates with a strip of magnetically attractable material positioned on the edge of the hood opening such that the door is retained in its closed position by a magnetic force. At least one door handle is mounted to the door at or near the end of the magnetic strip at the top of the door and can be pulled to open the door. The door is sufficiently flexible that pulling the handle causes a peeling effect such that relatively little force need be exerted to open the door from the corner, yet considerable force is required to open the door from inside the incubator by an infant residing therein.

6 Claims, 2 Drawing Sheets

MAGNETIC DOOR SEAL INFANT INCUBATOR

This application is a continuation-in-part of U.S. Ser. No. 08/492,683, filed Jun. 20, 1995, now abandoned.

BACKGROUND OF THE INVENTION

This invention relates to the field of infant incubators for containing an infant, and, more particularly, to an improved incubator having a front access door that provides simple and easy access to the infant.

In general, current incubators for infants contain a base for containing the equipment necessary to condition the air for the infant and that base supports a hood constructed of a transparent plastic and which forms an infant compartment that encloses the infant.

Within the infant compartment, therefore, an environment is maintained that supports the infant in a heated and humidified atmosphere that is regulated in accordance with various controls. Obviously, the hood must afford access to the infant by attending personnel and such access is generally provided by one or more hand holes, typical of which are shown and described in U.S. Pat. No. 5,129,897.

In addition, a larger front access door is normally provided so that the infant may be placed into the incubator, removed therefrom or for the nurse to administer to the infant requiring more access than is afforded by the handholes.

There are, of course, certain requirements for the front access door of an incubator, that is, it must be fairly easy to open from the outside since the nurse may be carrying objects and needs to open the door quickly and without disruption to the infant.

Also, the door must be resistant to opening from the inside, since, obviously, it is obviously dangerous for the door to be readily opened by the infant with a certain force pressed outwardly against the inside of the front access door.

In certain areas, international and domestic standards have been developed that incubator manufacturers must meet, that is, that the door cannot be opened by a force acting against the inside of the door of less than 20 newtons.

Typically, doors have latches that are manually opened by the attending nurse and which are located at opposite sides at the top of the door. While such latches certainly meet the requirement that the door not be easily opened from the inside, they are somewhat cumbersome and require separate operations by the nurse to open both of the latches manually.

Therefore it is advantageous to provide a front door for an infant incubator that is easy to open by a nurse from the outside with a minimum of manual operations, yet at the same time provide a door that meets the requirement that it not be openable by a force from the inside as might be exerted by an infant within the incubator.

SUMMARY OF THE INVENTION

The present invention provides a front access door for an infant incubator that is readily opened by an attendant from the outside and yet which is difficult to open by a force exerted against the inside surface. The door features a magnetic strip positioned at least substantially across the top of the door and which cooperates with a magnetic material affixed to the corresponding surface of the incubator hood to create a magnetic force holding the door in its closed position. It should be noted that the magnetic strip may, of course, be positioned on the door with a magnetic material on the hood or in the alternative, the magnetic strip may be affixed to the hood and the magnetic material affixed to the door.

In either case, the concept of a magnetic strip has been known for the sealing, for example, of refrigerator doors, however it has a unique and unexpected benefit when used on an access door of an infant incubator.

Specifically, the use of a magnetic strip on an incubator door makes the door quite difficult to open through a force exerted on the inside of the door. Accordingly, the magnetic strip closure can be used to meet the standards since a force in excess of 20 newtons can readily be required to open the door from the inside. The door is, therefore, protected against an infant opening the door of the incubator from the inside.

In addition, the door having a magnetic seal across at least the top thereof is readily opened by attending personnel without difficulty and without the manual unlatching of multiple latches. Since the plastic door has an inherent amount of flexibility, it may be opened by the attendant pulling the door outwardly from one of the upper corners, thus the door can be peeled away with respect to the magnetic seal and very little force is required to thus open the door from the outside. The magnetic seal covers substantially the linear width of the top of the incubator door, that is, at least about seventy percent (70%) of the width of the door. The elongated magnetic strip is thus susceptible of being pulled away from its corresponding strip of magnetically attractable material by the user pulling on a corner or upper edge of the door.

Since the strip is elongated substantially across the top of the door, as the door is pulled at one of its top corners, the magnetic strip and strip of magnetically attractable material are peeled apart and the amount of force to accomplish that peeling effect is relatively small and can be exerted by a nurse of other attending personnel.

The door can therefore be easily be opened by the attendant nurse by pulling one corner and the magnetic seal will peel away as the door is opened, thus the amount of force needed is relatively small and is readily opened by the nurse.

Accordingly, the magnetic seal of the present invention is easy to install on the door of an incubator, is easy to open from the outside, yet can meet the standards test that an infant on the inside cannot readily open the door since it requires a force pushing from the inside of about 20 newtons to open the door.

The foregoing and other advantages and features of the present invention will become readily apparent from the following description.

BRIEF DESCRIPTION OF THE DRAWINGS

The invention is diagrammatically illustrated by way of example in the drawings appended hereto, in which.

DETAILED DESCRIPTION OF THE PREFERRED EMBODIMENT

Figure 1:
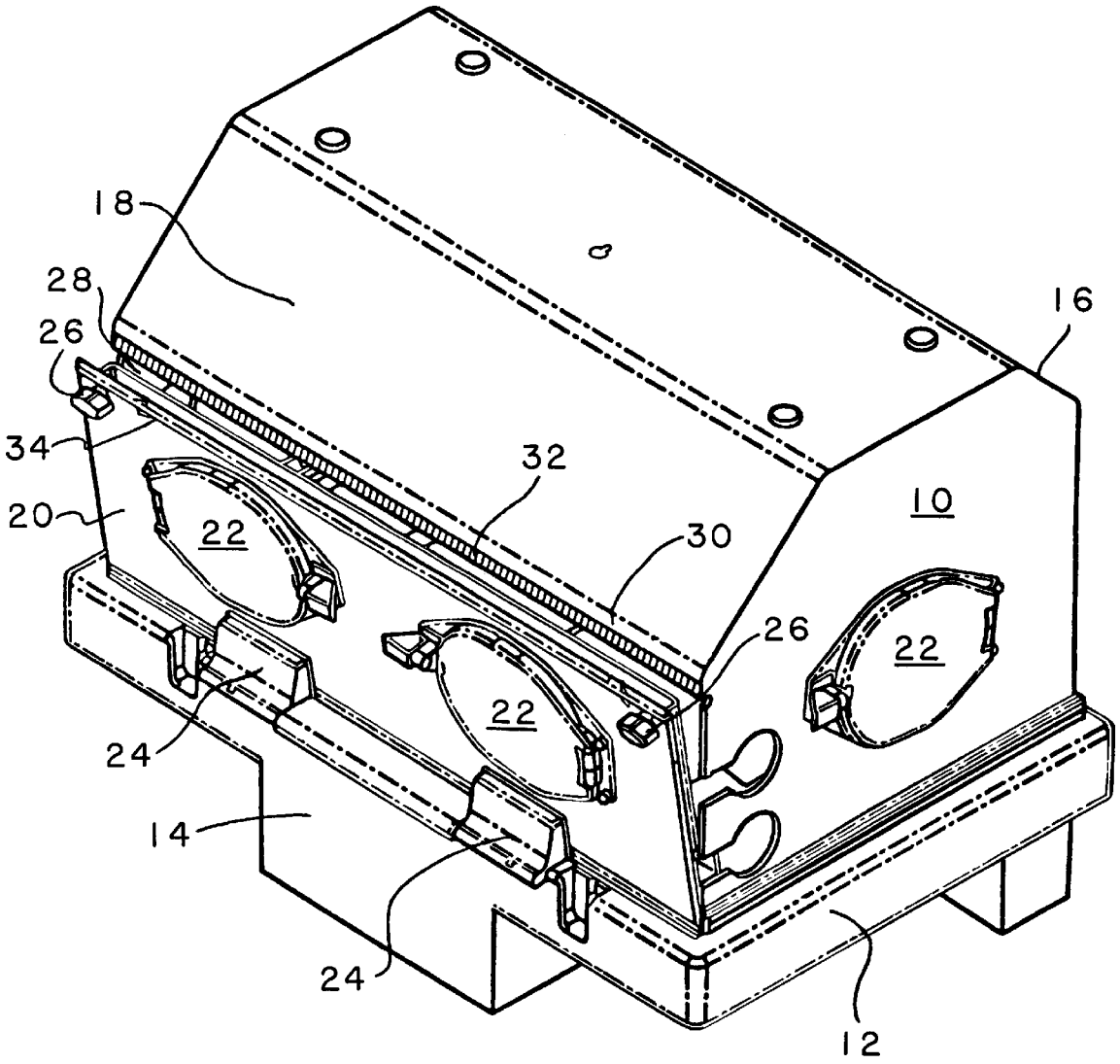
FIG. 1 is an isometric view of an incubator, typical of which is currently marketed and having incorporated therein, the magnetic door seal constructed in accordance with the present invention.

Turning first to FIG. 1, there is shown an isometric view of an infant incubator 10 having a base 12, preferably of a rigid structural material including aluminum or a plastic such as a polycarbonate, The base 12 contains most of the functioning equipment that provides a heated, humidified air for protection of the infant.

The base 12 may also include a panel 14 for locating various control switches, readouts and the like (not shown) through which the operator can control and monitor the atmosphere within which the infant is positioned.

A hood 16 overlies the base 12 and enclosed therein an infant compartment 18. The hood 16 is preferably made of a transparent material so that personnel may readily observe the infant contained therein and further includes a front access door 20 for such personnel to gain access to the infant for various procedures.

The hood 16 may be pivotally connected to the base 12 by means such as hinges located at the rear thereof so that the entire hood 16 may be raised when necessary. A typical hood 16 also include further means of access such as handholes 22 so that the attending personnel may insert their hands into the infant compartment 18 for carrying out operations on the infant but without severely upsetting or disturbing the environment within that infant compartment 18.

The front access door 20 is generally rectangular and is pivotally mounted to the base 12 by means such as door hinges 24 to allow opening and closing of the front access door 20.

Door handles 26 are positioned at the upper opposite corners of front access door 20 and the purpose of that particular location will be later explained. As shown, the door handles 26 are conventional latches which actually latch the front access door 20 in its closed position, however, with the present invention, the door handles 26 need not provide a positive latching function. As noted, front access door 20 is also constructed of a plastic material that is transparent and which is semi-rigid, that is, there is a designed amount of flexibility built into the front access door 20 as will also be later explained.

As will be seen by FIG. 1, the opening 28 across the front of the incubator 10 is thus opened to allow access to the infant or closed to protect the internal environment by opening and closing the front access door 20. The opening 28 is therefor also preferably rectangular and has its top defined by the lower edge 30 of the hood 16. A strip 32 of magnetically attractable material is adhered to the lower edge 30 of the hood 16 and is of a material that is attracted by a permanent magnet. The preferred strip is of a metal and preferably of steel. The strip 32 may be fastened in the desired position by any suitable adhesive or hardware and preferably the strip 32 runs substantially all along the lower edge 30 of the hood 16 and, more preferably, all of the way across that lower edge 30 of one entire top side of the rectangular opening 28 in the hood 16. In the preferred embodiment, the strip 32 covers at least about seventy percent (70%) of the linear length of the lower edge 30 of the hood 16.

A permanent magnetic strip 34 is also positioned at the top edge 36 of the front access door 20, and again, preferably runs substantially across the front access door 20, and more preferably all the way along the length of the top edge 36 of the rectangular front access door 20. Again, it is preferred that the permanent magnetic strip 34 runs at least about seventy percent (70%) of the linear length of the top edge 36 of the front access door 20 to achieve the peeling effect that is desired in carrying out the present invention. More preferably, both the strip 32 of magnetically attractable material and the permanent magnetic strip run the entire length of the access door 20 and the lower edge 30 of the hood 16.

The permanent magnetic strip 34 may be of a flexible material, commonly used in refrigerator doors, however, it its preferably in the shape of an h, so as to slip over the top edge 36 of the front access door 20 and have an upstanding flange 38 that is of a magnetic material. In general, the magnetic strip 34 is a flexible plastic material having a permanent magnetic material extruded into the shape of the magnetic strip 34.

Figure 2:
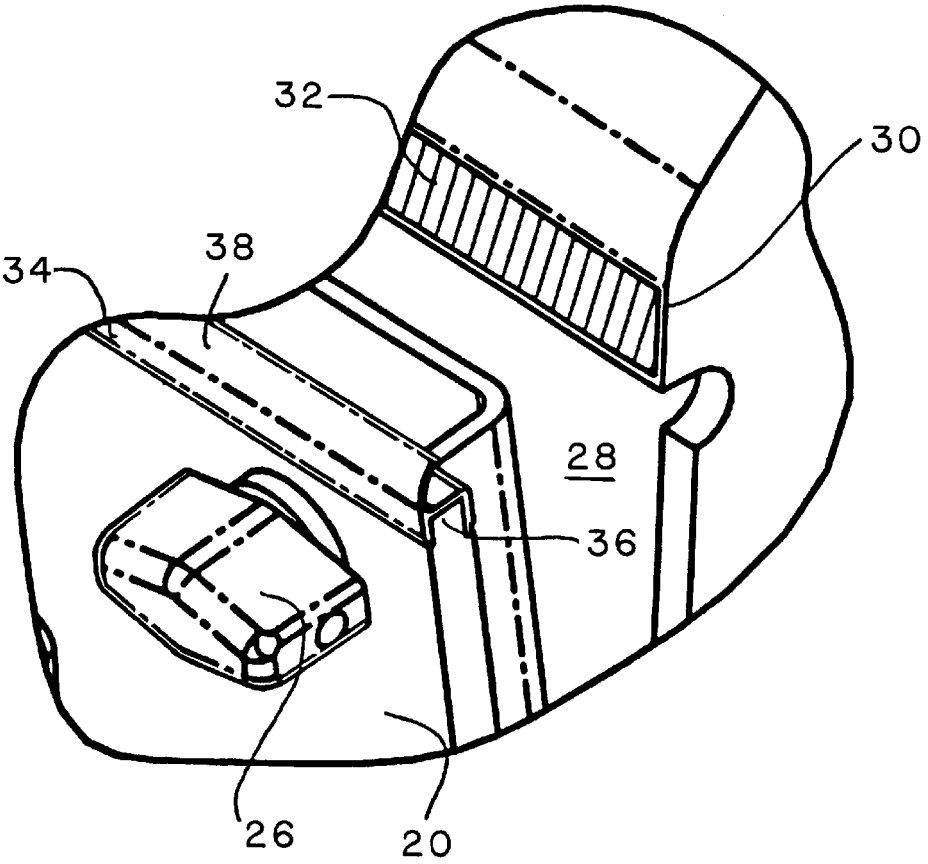
FIG. 2 is an enlarged schematic side view of an incubator similar to the FIG. 1 incubator and having a magnetic seal for affixing the incubator door in its closed position in accordance with the present invention.

Turning now to FIG. 2, there is shown an enlarged schematic view of the top edge 36 of the front access door 20 slightly ajar from the lower edge 30 of the incubator hood 16 and showing, in more detail, the positions of the strip 32 of magnetically attractable material, and the location and the means of attaching the permanent magnetic strip 34 atop the top edge 36 of the front access door 20. As can be seen, the upstanding flange 38 of the h-shaped permanent magnetic strip 34 is positioned so as to align with the strip 32 of magnetically attractable material located on the lower edge 30 of the incubator hood 16 and the lower, open part of the h shape can readily fit over the top edge 36 of the front access door 20.

Figure 3A:
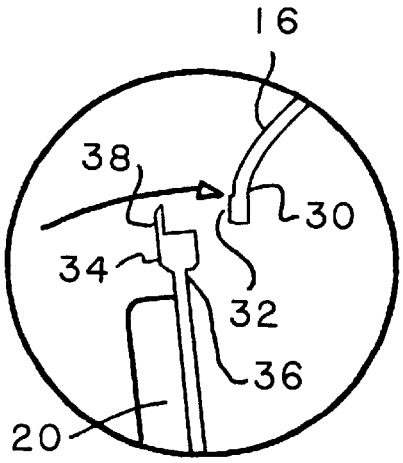
FIG. 3A and 3B are enlarged schematic views of the door and hood construction of FIG. 2 having the door in the partially opened condition and in the closed condition, respectively.
Figure 3B:
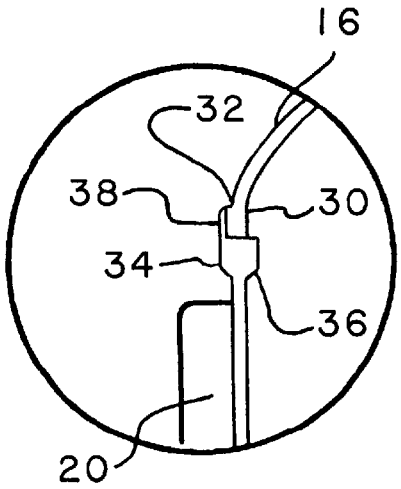

Further schematic views FIG. 3A and 3B show the preferred alignment of the permanent magnetic strip 34 and the lower edge 30 of the hood 16 having affixed thereon the strip 32 of magnetically attractable material. In FIG. 3A, the front access door 20 is slightly ajar and in FIG. 3B, the front access door 20 is closed and the upstanding flange 38 of the permanent magnetic strip 34 aligns with the strip of magnetically attractable material to create a magnetic seal to retain the front access door 20 in the closed position.

Accordingly, returning to FIG. 1, the operation of the front access door 20 can now be explained. By the positioning of the door handles 26 at the top, opposite ends of the front access door 20, the advantage can be taken of the inherent flexibility of the material used to construct the front access door 20. In particular, the door handles 26, being located at the far ends of the top of the front access door 20 can be pulled outwardly by one attempting to open the front access door 20 and the pulling force acts locally at the upper edge of the front access door 20 to defeat the magnetic attraction that is retaining the front access door 20 in the closed position.

By acting locally, it is relatively easy to break the magnetic attraction and pull the upper corner of the front access door 20 away from the lower edge 30 of the hood 16. As the operator continues to pull on the hood latch 26, the upper edge of the front access door 20 and the permanent magnetic strip 34 is progressively separated from the strip 34 of magnetically attractable material and causing the front access door 20 to basically peel away from the incubator hood 16 progressively across the top of the front access door 20. Thus, the force required to open the front access door 20 is relatively small since the entire magnetic attraction is not broken at one time; to the contrary, the magnetic attraction is broken progressively across the top edge 36 of the front access door 20 as the operator continues the pulling force.

Conversely, when the front access door 20 is closed and the infant attempts to open the front access door 20 or inadvertently bumps the front access door 20 from the inside, the force exerted by the infant is almost always generally directed at the center of the inside surface of the front access door 20 and it must break the magnetic attraction on the entire mating surfaces of the permanent magnetic strip 34 and the strip 32 of magnetically attractable material. Thus, the door is very difficult to open by any force against the inside surface of the front access door 20 exerted in the normal areas that an infant would direct such a force.

Therefore, the opening of the front access door 20 is relatively easy when accomplished by a user from the outside and exerting that force at either end of the front access door 20 at the top corners where the door handles 26 are positioned, yet the opening of the front access door 20 from the inside by a force against the inner surface of the front access door 20 as would be done by an infant, results in a considerable force necessary to open the front access door 20.

It will be understood that the scope of this invention is not limited to the particular steps or materials disclosed herein, by way of example, but only by the scope of the appended claims.

We claim:

1. An infant incubator comprising a base and a hood supported on and overlying the base adapted to enclose therein an infant, said hood having an opening therein for obtaining access to the infant, said opening being defined partially by an edge formed in said hood and having a linear length, a door for opening and closing the opening, said door having opposing edges, one of said edges of said door being pivotally affixed to said hood to allow said door to pivot between the open and the closed positions and the other edge of said door having a linear length and aligning with said edge formed in said hood when said door is in the closed position, a permanent magnetic strip located substantially along the other edge of said door having two outer ends or along said edge formed in said hood, and a strip of magnetically attractable material affixed, respectively, substantially along said edge formed in said hood or said other edge of said door, said permanent magnetic strip and said strip of magnetically attractable material mounted so as to be aligned when said door is in the closed position to magnetically retain the door in the closed position, a handle mounted on said door and positioned adjacent at least one of said outer ends of said permanent magnetic strip and said strip of magnetically attractable material to allow easy opening of said door by pulling said handle outwardly to peel said magnetic strip progressively from its magnetic retention to said strip of magnetically attractable material.

2. An infant incubator as defined in claim 1 wherein said permanent magnetic strip or strip of magnetically attractable material extends along the other edge of said door at least about seventy percent of the linear length of said edge of said door and at least about seventy percent along the linear length of said edge formed in said hood.

3. An infant incubator as defined in claim 2 wherein said strip of magnetically attractable material is affixed substantially entirely along the length of the upper door edge or edge of hood overlying the opening.

4. An infant incubator as defined in claim 1 wherein said strip of magnetically attractable material is a steel strip.

5. An infant incubator as defined in claim 1 wherein said magnetic strip is a flexible plastic strip having a cross section that is h-shaped.

6. An infant incubator as defined in claim 5 wherein said upstanding flange of said h-shaped strip aligns with said magnetically attractable strip.

* * * * *